US006622439B2

(12) United States Patent
Moreno, Jr.

(10) Patent No.: US 6,622,439 B2
(45) Date of Patent: Sep. 23, 2003

(54) FOUNDATION STABILIZATION SYSTEM FOR MANUFACTURED HOUSING

(75) Inventor: Albert M. Moreno, Jr., Hendersonville, NC (US)

(73) Assignee: Minute Man Anchors, Inc., East Flat Rock, NC (US)

( * ) Notice: Subject to any disclaimer, the term of this patent is extended or adjusted under 35 U.S.C. 154(b) by 66 days.

(21) Appl. No.: 10/060,869

(22) Filed: Jan. 30, 2002

(65) Prior Publication Data

US 2003/0140578 A1 Jul. 31, 2003

(51) Int. Cl.[7] ..... E02D 5/74; E02D 27/32

(52) U.S. Cl. ..... 52/169.1; 52/155; 52/292

(58) Field of Search ..... 52/169.12, 299, 52/155, 167.3, 292, 695, 126.6, 741.1, 146, 23, DIG. 3, DIG. 11, 169.9, 143, 741.11, 741.15; 248/680, 681, 122.1, 124.1, 188.4, 188.1, 354.5, 100, 228, 228.1, 228.3, 228.5, 316.4, 316.8, 499, 500

(56) References Cited

U.S. PATENT DOCUMENTS

| | | | | | |
|---|---|---|---|---|---|
| 162,800 | A | | 5/1875 | Colwell | |
| 187,337 | A | | 2/1877 | Wing et al. | |
| 709,300 | A | | 9/1902 | Buchtel | |
| 1,764,207 | A | | 6/1930 | Johnson | |
| 3,655,160 | A | | 4/1972 | Grillot | 248/188.8 |
| 3,750,349 | A | * | 8/1973 | Deike | 52/4 |
| 3,751,866 | A | * | 8/1973 | Renchen | 52/149 |
| 3,830,024 | A | * | 8/1974 | Warnke | 52/23 |
| 3,830,457 | A | | 8/1974 | Stewart | 248/361 |
| 4,037,835 | A | | 7/1977 | Forsyth | 272/65 |
| 4,148,162 | A | | 4/1979 | Goodrich | 52/23 |
| 4,258,514 | A | | 3/1981 | St. Clair | 52/86 |
| 5,848,507 | A | * | 12/1998 | Bozich | 52/299 |
| 5,873,679 | A | | 2/1999 | Cusimano | 405/231 |
| 6,058,663 | A | | 5/2000 | MacKarvich | 52/167.3 |
| 6,247,276 | B1 | * | 6/2001 | Masters et al. | 52/169.12 |
| 6,282,856 | B1 | * | 9/2001 | MacKarvich | 52/299 |
| 6,295,784 | B1 | * | 10/2001 | Menke et al. | 52/741.15 |
| 6,318,032 | B2 | * | 11/2001 | MacKarvich | 52/167.3 |
| 6,334,279 | B1 | * | 1/2002 | Oliver et al. | 52/127.2 |
| 6,347,489 | B1 | * | 2/2002 | Marshall, Jr. et al. | 52/169.9 |
| 6,546,686 | B2 | * | 4/2003 | MacKarvich | 52/299 |
| 6,550,199 | B2 | * | 4/2003 | Phillips | 52/294 |
| 6,568,147 | B1 | * | 5/2003 | Sumner, Sr. | 52/745.12 |

* cited by examiner

*Primary Examiner*—Jeanette E. Chapman
(74) *Attorney, Agent, or Firm*—McNair Law Firm, P.A.; Cort Flint

(57) ABSTRACT

A foundation stabilization system is disclosed for bracing a manufactured home on its foundation of the type which includes a plurality of vertical piers spaced in longitudinal and lateral directions relative to a longitudinal axis of said home which support the home above the ground, and at least one elongated brace connected between the mobile home and base portion of the pier. The system includes foundation plate having a lower ground contact surface for contacting the ground, and an upper pier support surface on which the pier is supported. Anchor slots are formed in the foundation plates for receiving ground anchors extending through the plates into the ground. The anchor slots including first slot segments extending in the longitudinal direction of the manufactured home when supporting the piers and second slot segments extending in the lateral direction. The first and second slot segments intersecting each other at a predetermined angle. The foundation plates are reliably anchored in the ground to resist forces in the longitudinal and lateral directions when groung anchors with corresponding intersecting legs are driven through the first and second anchor slots. The ground anchors include elongated metal angle stakes wherein the angle stakes have elongated first legs and second legs intersecting one another to provide a cross-section generally corresponding to the angle anchor slots of the foundation plates.

20 Claims, 3 Drawing Sheets

FOUNDATION STABILIZATION SYSTEM FOR MANUFACTURED HOUSING

BACKGROUND OF THE INVENTION

This invention relates to a foundation stabilization system for bracing and stabilizing manufactured homes and the like portable buildings on their foundations, and particularly to a foundation plate for a foundation pier support which can be easily adjusted in its foundation supporting position on the ground and then securely anchored in that position.

Heretofore, numerous foundation stabilization and anchoring systems have been proposed for anchoring and stabilizing manufactured homes and the like. Typically, the manufactured home or building has a chassis which is formed from a plurality of laterally spaced longitudinal I-beams. The manufactured home is generally supported by a plurality of axles positioned approximately in the center of the manufactured home to permit transporting the home. The manufactured home is installed or set up in a permanent location by providing block supports, jacks, or other pier foundations around the periphery and center of manufactured home.

In known prior art installation systems, for example, the supports are formed of concrete blocks, or other similar support structures, that rely on the compressional force of the manufactured home to hold the home in place on concrete pads or other suitable foundation pads. Typically, anchor members are secured in the concrete pads with the manufactured home supported above the pads by means of blocks or other mechanical piers. However, the position of the concrete pads is difficult to adjust while supporting the piers and building in the alignment of the support system. It has become increasing popular to use metal and other light weight foundation plates which can be anchored into the ground, yet are strong enough to support blocks, or other piers, on which the manufactured home rests. The system shown in U.S. Pat. No. 4,261,149 is typical of present support systems using a foundation pad, pier, and longitudinal and lateral bracing struts which are secured between the manufactured home and the foundation pad. However, when using non-concrete plates anchoring of the plates into the ground is required before the pier is constructed and the braces are affixed. This causes the problem that it is difficult or impossible to reposition the plates for alignment. The plates have already been anchored in the ground by anchors such as spikes or cleat walls. For example, U.S. Pat. No. 6,058,663 has proposed the use of a one piece metal foundation plate which is stamped out, the edges are bent down to form cleat walls, and the bent down cleat walls are embedded in the soil to prevent the plate from shifting. While this type of plate is secured in shifting laterally or longitudinally, it is difficult to adjust the position of the plate once it has been embedded in the soil and the weight of the pier rests on the foundation plate.

It has also been known to provide foundation plates having separate spikes which can be driven through the plate once the plate is positioned. For example, U.S. Pat. No. 5,873,679 discloses a foundation pier for removable dwelling such as manufactured home having an anchor assembly for anchoring the pier to the ground. That invention relates to a height adjustment for the pier so as to engage the I-beam of the home. However, the rods which are driven into the ground must be driven at such an angle that, depending on the height of the pier, it may be more or less difficult to drive the rods into the ground after alignment because of limited space.

Accordingly, an important object of the present invention is to provide a foundation stabilization system for a manufactured home and the like having a foundation plate which can be adjusted under the pressure of a weighted pier and then anchored to the ground.

Another object of the present invention is to provide a foundation plate for a manufactured home foundation stabilization system having preformed ground anchor locations which can receive different types of ground anchors to accommodate different soil applications.

Yet another object of the present invention is to provide a foundation plate for a manufactured home foundation system to which longitudinal or lateral braces can be secured wherein the foundation plate can be easily adjusted in its position on the ground for alignment of the braces while supporting at least the partial weight of the manufactured home, and thereafter being anchored to the ground.

Still another important object of the present invention is to provide a manufactured home foundation system having a foundation plate with preformed ground anchor slots which can accommodate different size anchors for different ground soil types.

SUMMARY OF THE INVENTION

The above objectives are accomplished according to the present invention by providing a foundation system for bracing and stabilizing a manufactured home or building on its foundation of the type which includes a plurality of vertical piers spaced in first and second directions relative to a longitudinal axis of the home which supports the home above the ground, and at least one elongated brace connected to the mobile home and a location near a base portion of the pier. The system comprises a foundation plate having a lower surface for contacting the ground, and an upper pier support surface on which the pier is supported. The pier support surface of the foundation plate has a surface area greater than the pier. A plurality of anchor slots are formed in the foundation plate which include first slot segments extending in a first direction and second slot segments extending in a second direction. The first and second slot segments intersect each other at a predetermined angle. Elongated ground anchors are driven through the anchor slots to extend into the ground beneath the foundation plate. The ground anchors have first anchor legs and second anchor legs intersecting one another at an angle generally corresponding to the predetermined angle of the first and second slot segments. The anchor legs and the first slot segments act together to resist movement of the foundation plates in the second direction. The second anchor legs and the second slot segments act together to resist movement of the foundation plates in the first direction. The foundation plates are reliably anchored in the ground to resist forces in the first and second directions when the pier is supported on the foundation plates and the ground anchors are driven through the anchor slots and the foundation plates.

Preferably, the anchor slots are located at the corners of the foundation plates located outside the pier support area for receiving the elongated ground anchors which are advantageously driven, generally perpendicularly, through the anchor slots.

The first and second anchor slot segments include closed ends and open ends, where the open ends of the first and second anchor slot segments open into each other to form angle anchor slots having a predetermined angle. Preferably, the foundation plates are rectangular having four intersecting sides, and the anchor slots are formed at corners of the foundation plates. The first and second slot segments extend along the intersecting sides of the foundation plate at the corners. The intersecting sides of the foundation plates extend upwards from the pier support surface to form a support tray facilitating placement and retention of the pier structure upon the foundation plate. Quite advantageously, the first and second slot segments of the anchor slot segments have a sufficient length to accommodate the use of ground anchors having anchor legs of different widths in accordance with the type of soil in which the anchors are to be driven.

According to the method of the invention, a method for bracing and stabilizing a foundation system of a manufactured home and the like which includes providing foundation plates having anchor slots which include first slot segments extending in a first direction second slot segments extending in a second direction where the first and second slot segments intersect each other a predetermined angle. The method includes placing the foundation plates underneath the chassis of the manufactured home and placing piers on the foundation plate underneath the chassis so that the piers extend between the foundation plates and chassis. Next, brace struts are affixed between the chassis and the pier or foundation plates extending in the first or second directions. The method includes providing elongated ground anchors having first and second anchor legs intersecting one another at an angle generally corresponding to the predetermined angle of the first and second slot segments and driving the elongated ground anchors through the anchor slots into the ground. In this method, the first anchor legs and the first slot segments act together to resist movement of the foundation plates in the second direction, and the second anchor legs and the second slot segments act together to resist movement of the foundation plates in the first direction so that the foundation plates are reliably anchored to the ground. The method further includes adjusting the position of the foundation plates, if necessary, while supporting loaded piers beneath the chassis prior to driving the ground anchors through the anchor slots. Advantageously, the method may also include providing the foundation plates having first and second slot segments to accommodate ground anchors having different width legs, and selecting ground anchors having a desired width and length depending on the type of soil receiving the anchors.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
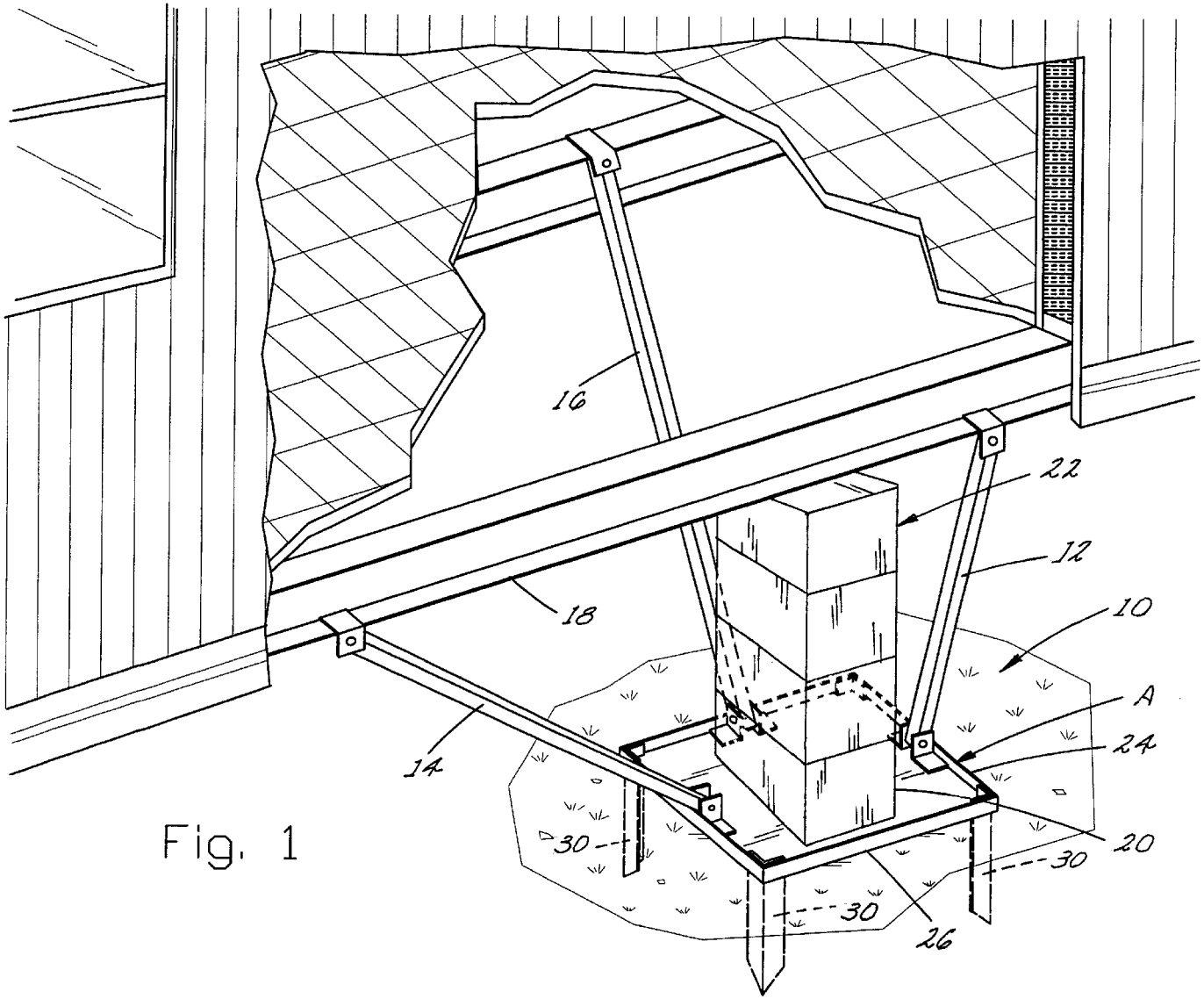
FIG. 1 is a perspective view with parts cut away illustrating the stabilization system for a manufactured home having an anchored foundation plate according to the invention.

Referring now to the drawings, the invention will now be described in more detail.

As can best be seen in FIG. 1, a foundation stabilization system, designated generally as A, is illustrated for stabilizing and anchoring a manufactured home and the like portable building, which includes an adjustable foundation plate B to which a plurality of brace struts 12, 14, and 16 may be attached. Struts 12 and 14 are typically attached to an I-beam 18 of the pre-manufactured home chassis to brace and stabilize the home or building in a first, longitudinal direction. Strut 16 is typically attached to a parallel I-beam 18 for bracing in a second, lateral direction. In the illustration embodiment, a pier 20 is supported on foundation plate B which may be provided by stacked concrete blocks 22, or other suitable pier construction, such as mechanical jacks, towers, etc.

Referring now in more detail to adjustable foundation plate B, it can be seen that foundation plate B includes an upper support tray 24 formed by side walls 26 which surround the periphery of the plate. Preferably the plate is formed of metal, with the side walls 26 being formed by folding up edges of the plate and securing them together at the corners, such as by welding. Support tray 24 includes a pier support surface 24*a* upon which concrete blocks 20, or other suitable pier structure, may be placed on plate B. The opposite side of foundation plate B provides a ground contact surface 24*b* with the plate positioned on the ground. Ground contact surface is generally smooth, i.e., there is no structure penetrating into the ground that would prevent at least slight movement on the ground when the plate is loaded or unloaded. It is noted the peir area 24*c* is smaller than pier support surface 24*a*.

Figure 2:
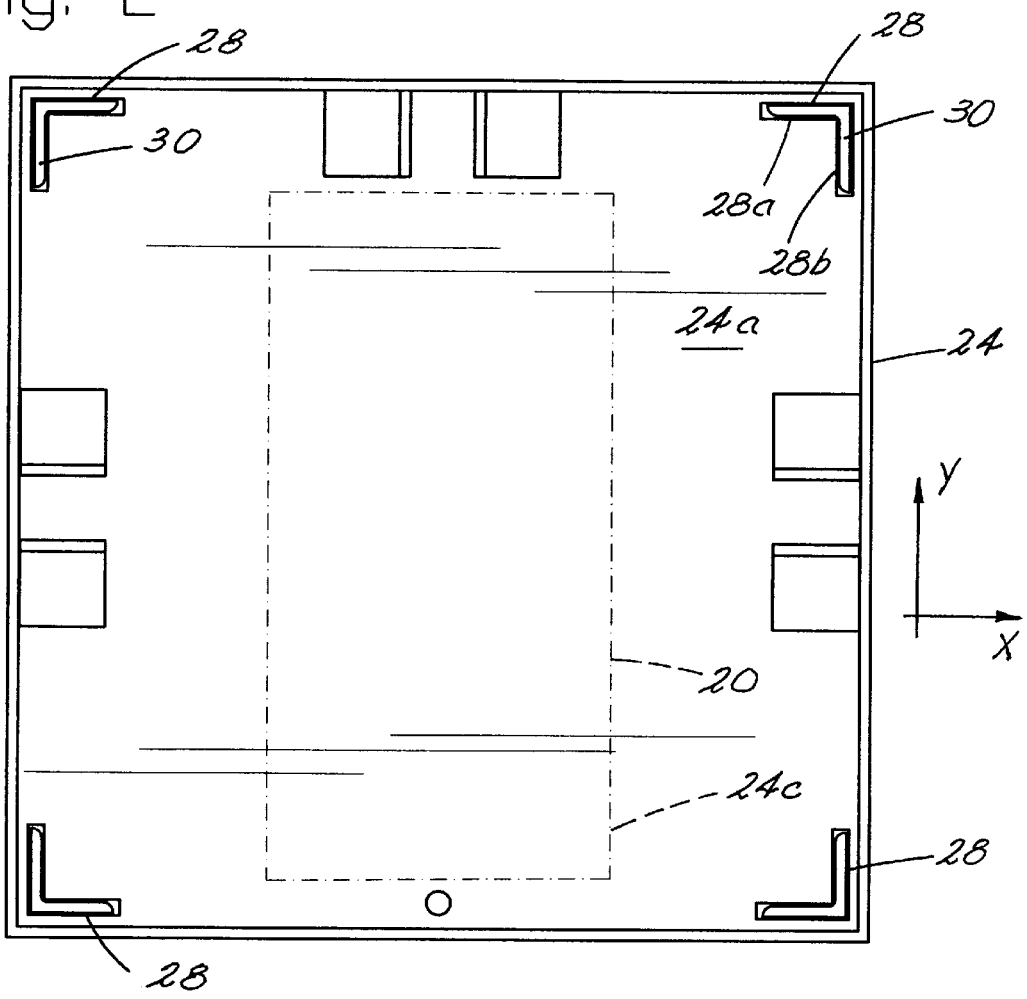
FIG. 2 is a top plan view of an anchored foundation plate for a manufactured home stabilization system according to the invention.
Figure 3:
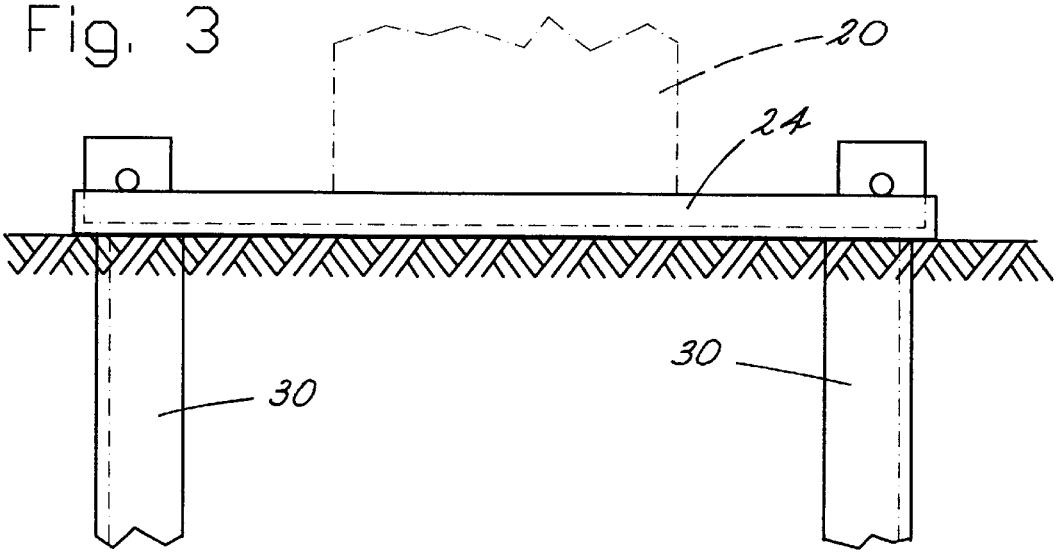
FIG. 3 is a side elevation of an anchored foundation plate for a manufactured home stabilization system according to the invention.
Figure 4:
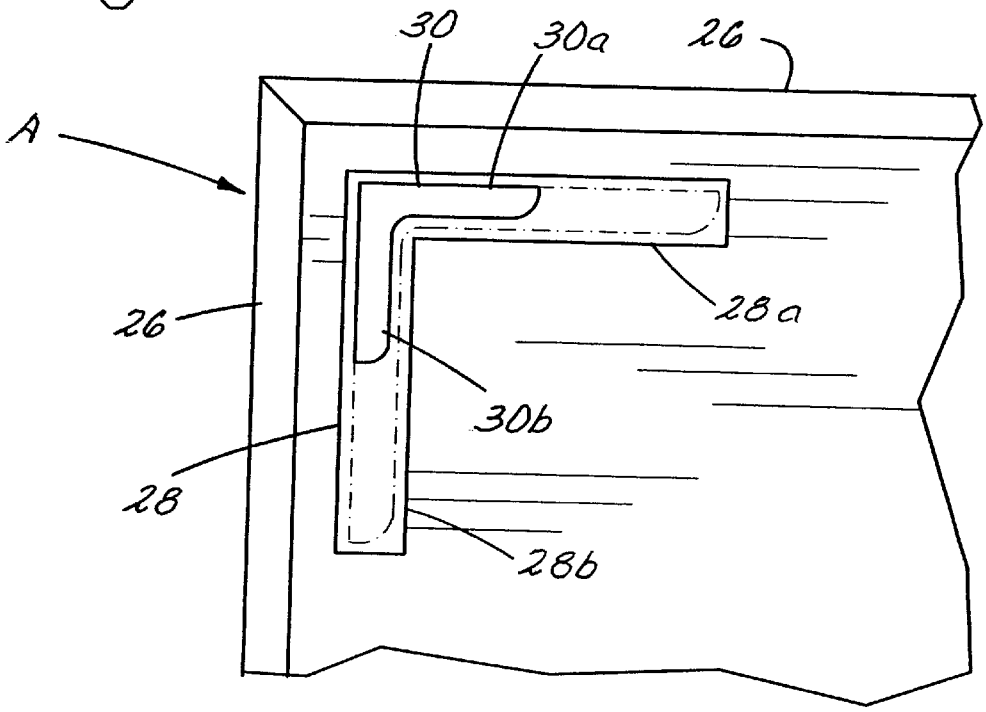
FIG 4 is an enlarged cut away of a corner section of an anchored foundation plate according to the invention which accommodates variable sized anchors.
Figure 5A:
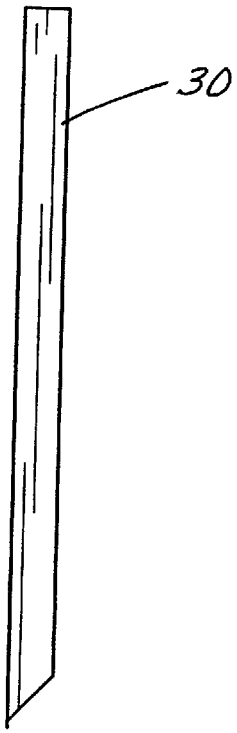
FIG. 5*a* and FIG. 5*b* are side elevations of two examples of two different sized anchors which may be employed with adjustable foundation plate according the invention.
Figure 5B:
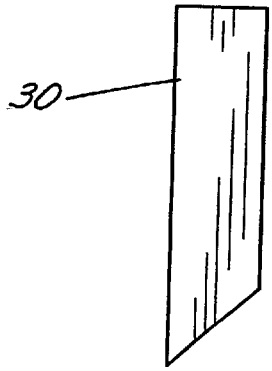

As can best be seen in FIG. 2, the corners of the foundation plate include anchor slots 28 for receiving ground anchors 30. Anchor slots 28 include intersecting slot segments 28*a* and 28*b*. Preferably, slot segments 28*a* and 28*b* intersect generally at right angles that slot segment 28*a* extends in a first, longitudinal direction "X" and slot 28*b* extends in a second, lateral direction "Y" (FIG. 4). Slot segments 28*a*, 28*b* include closed ends 29*a* and open ends 29*b*. Open ends 29*b* of the slots communicate with each other to form an angle slot which receives a corresponding shaped angle anchor stake 30 as described below. As can best be seen in FIGS. 1–3, elongated ground anchors 30 are driven through anchor slots 28 to anchor foundation plate B in place. Ground anchors 30 include intersecting legs 30*a* and 30*b* corresponding to anchor slots 28*a* and 28*b* so that the anchors may be driven through the slots. For this purpose, ground anchors may be formed by typical angle iron or other metal. In this case, leg 30*a*, as slot 28*a*, extends in the first, longitudinal direction, and anchor leg 30*b* extends in the second, lateral direction. It is noted that the anchors can be driven straight through the foundation plate (i.e., generally perpendicular) into the ground so that they may be easily driven into the ground by the use of a heavy hammer, even after the loaded piers bearing the weight is supported on the plate.

Depending on the type of soil which provides the foundation for the manufactured home different sized anchors.-

For example, the following chart lists some preferred dimensions for anchors and different types of soil.

TABLE 1

SOIL CLASSIFICATION CHART

| SOIL CLASS | SOIL DESCRIPTION | GROUND ANCHOR SIZE |
|---|---|---|
| 2(a) | Very dense &/or cemented sands, course gravel and cobbles, caliche, preloaded silts, and clay. | 12" × 1" × 1" or 8" × 2" × 2" |
| 2(b) | Coral | 12" × 1" × 1" or 8" × 2" × 2" |
| 3 | Medium dense coarse sands, sandy gravels, very stiff silts, and clays. | 12" × 1" × 1" or 8" × 2" × 2" |
| 4(a) | Loose to medium dense sands, firm to stiff clays and silts alluvial fill. | 16" × 1" × 1" or 12" × 2" × 2" |
| 4(b) | VERY loose to medium dense sands, firm to stiff clays and silts, alluvial fill. | 16" × 1" × 1" or 12" × 2" × 2" |

As can best be seen in FIG. 4, anchor slots 28 may be dimensioned to accommodate various size anchors while still affording good anchoring of foundation plate B. Due to the generally angle-shaped cross section of the ground anchors 30, and the corresponding shape of anchor slots 28, resistance to shifting in both the longitudinal and lateral direction are provided by the ground anchor and anchor slot arrangement regardless of the size of the anchor. Thus, an advantageous construction and method can be had for anchoring foundation plates in different types of soils by using different types of anchors without the need for providing different sized foundation base.

In use, multiple foundation systems A can be provided underneath the I-beams of the manufacture homes or buildings in desired locations. Concrete blocks, or other piers, can be placed on the foundation plate and the manufactured home can be lowered onto the foundation plates or other method of installing the pier beneath the home utilized. During the installation process, the foundation plate can be adjusted slightly in its position by applying forces to the side walls of the plate while supporting pier weight, and prior to the anchoring of the plate to the ground using ground anchors 30. When the foundation plates are properly aligned for struts 12, 14, 16, ground anchors 30 can then be driven through the anchor slots corner of the ground plate. An advantageous construction can be had for an adjustable foundation plate which can be sufficiently adjusted in its position even if the load of the manufactured home has been placed on the pier prior to the time the ground anchors are set in place. If needed, the foundation plate may be secured through the tops of the ground anchors using bolts inserted through aligned holes in side walls 26 and angle legs 30*a*, 30*b* of the anchors.

While a preferred embodiment of the invention has been described using specific terms, such description is for illustrative purposes only, and it is to be understood that changes and variations may be made without departing from the spirit or scope of the following claims.

What is claimed is:

1. A foundation system for bracing a manufactured home on its foundation of the type which includes a plurality of vertical piers spaced in first and second directions relative to a longitudinal axis of said home which support the home above the ground, and at least one elongated brace connected to the mobile home and a location near a base portion of said pier, wherein the system comprises:

a foundation plate having a lower surface for contacting the ground, and an upper pier support surface on which said pier is supported, where said pier support surface of said foundation plate has a surface area greater than the pier;

a plurality of anchor slots formed in said foundation plate;

said anchor slots including first slot segments extending in a first direction and second slot segments extending in a second direction, and said first and second slot segments intersecting each other at predetermined angle;

a plurality of elongated ground anchors for being driven through said anchor slots to extend into the ground beneath said foundation plate; and said ground anchors having first anchor legs and second anchor legs intersecting one another at an angle generally corresponding to said predetermine angle of said first and second slot segments;

said first anchor legs and said first slot segments acting together to resist movement of said foundation plates in said second direction, and said second anchor legs and said second slot segments acting together to resist movement of said foundation plates in said first direction;

whereby said foundation plates are reliably anchored in the ground to resist forces in said first and second directions when said pier is supported on said foundation plates and said ground anchors are driven thur said anchor slots and said foundation plates.

2. The system of claim 1 wherein said anchor slots are located at corners of said foundation plates located outside the pier support area for receiving said elongated ground anchors to be driven generally perpendicularity through said anchor slots.

3. The system of claim 2 wherein said anchor slot segments are formed as cut-outs in said foundation plate.

4. The system of claim 3 wherein said first and second anchor slot segments including closed ends and open ends, said open ends of said first and second anchor slot segments opening into each other to form angle anchor slots having said predetermined angle.

5. The system of claim 4 wherein said foundation plate is rectangular having four intersecting sides; and said anchor slots are formed at corners of said foundation plates with said first and second slot segments extending along said intersecting sides of said foundation plate at said corners.

6. The system of claim 5 wherein said intersecting sides of said foundation plates extend upwards from said pier support surface to form a support tray facilitating placement and retention of said pier structure upon said foundation plate.

7. The system of claim 1 wherein said first and second slot segments of said anchor slot segments have a sufficient length to accommodate the use of ground anchors having anchor legs of different widths in accordance with type of soil in which the anchors are to be driven.

8. The system of claim 1 wherein said ground anchors include elongated angle-metal stakes having said first and second legs intersecting one another to provide a cross-section generally corresponding to said anchor slots of said anchor foundation plate.

9. A foundation system for bracing a manufactured home on its foundation of the type which includes a plurality of vertical piers spaced in longitudinal and lateral directions relative to a longitudinal axis of said home which support the home above the ground, and at least one elongated brace connected to the mobile home and a location near a base portion of said pier, wherein the system comprises:

a foundation plate having a lower ground contact surface for contacting the ground, and an upper pier support surface on which said pier is supported;

a plurality of anchor slots carried by said foundation plate for receiving ground anchors extending through said plate into the ground beneath said manufactured home; and said anchor slots including first slot segments extending in the longitudinal direction of said manufactured home when supporting said piers and second slot segments extending in the lateral direction, and said first and second slot segments intersecting each other a predetermined angle;

whereby said foundation plates may be anchored in the ground to resist forces in said longitudinal and lateral directions when groung anchors with corresponding intersecting legs are driven through said first and second anchor slots.

10. The system of claim 9 including a plurality of elongated ground anchors including elongated stakes with first and second intersecting legs corresponding in cross-section generally to the shape of said first and second slot segments of said anchor slots, said first anchor leg and said first anchor slot segment resisting movement of said foundation plate in said lateral direction, and said second anchor leg and said second anchor slot segments resisting movement of said foundation plates in said longitudinal direction when said ground anchors are driven through said anchor slots of said foundation plates.

11. The system of claim 10 wherein said anchor slots are formed as cut-outs in said foundation plate.

12. The system of claim 11 wherein said plate cut-outs include said first and second anchor slot segments having closed ends and open ends, said open ends of said first and second anchor slot segments opening into each other to form an angle anchor slot.

13. The system of claim 9 wherein said foundation plate is rectangular having four intersecting sides; and said angle anchor slots are formed at corners of said foundation plate with said first and second slot segments extending along intersecting sides of said foundation plate at each said corner.

14. The system of claim 9 wherein said first and second slot segments of said anchor slots have a sufficient length to accommodate ground anchors having anchor legs of different widths.

15. The system of claim 14 wherein said ground anchors include an elongated metal angle stake wherein the angle stakes have elongated first legs and second legs intersecting one another to provide a cross-section generally corresponding to said angle anchor slots of said foundation plates.

16. A method for bracing and stabilizing a foundation system of a manufactured home and the like wherein the foundation of the home is of the type which includes chassis support on a plurality of vertical piers which support the home above the ground, and at least one elongated brace connected to the home and a location near a base portion of said pier, wherein the method comprises:

providing foundation plates having a plurality of anchor slots which include first slot segments extending in a first direction second slot segments extending in a second direction where said first and second slot segments intersect each other a predetermined angle;

placing said foundation plates underneath the chassis of said manufactured home;

placing piers on said foundation plate underneath said chassis so that said piers extend between said foundation plates and said chassis;

affixing brace struts between the chassis and one of said pier and foundation plates in at least one of said first and second directions;

providing ground anchors having first and second anchor legs intersecting one another at an angle generally corresponding to said predetermined angle of said first and second slot segments; and driving said elongated ground anchors through said anchor slots into the ground beneath said foundation plate;

whereby said first anchor legs and said first slot segments act together to resist movement of said foundation plates in said second direction, and said second anchor legs and said second slot segments act together to resist movement of said foundation plates in said first direction so that said foundation plates are reliably anchored in the ground.

17. The method of claim 16 including providing said anchor slots are located at corners of said foundation plates located outside the pier support area of said plates and driving said elongated ground anchors generally perpendicularly through said anchor slots.

18. The method of claim 16 including adjusting the position of said foundation plates while supporting said piers beneath chassis prior to driving said ground anchors through said anchor slots.

19. The method of claim 18 including adjusting said plate after affixing said brace struts.

20. The method of claim 16 including providing said foundation plate having first and second slot segments to accommodate ground anchors having different width legs, and selecting ground anchors having a desired width and length depending on the type of soil receiving said anchors.

* * * * *